United States Patent [19]

Perry

[11] Patent Number: 5,057,349

[45] Date of Patent: Oct. 15, 1991

[54] INSERT FOR USE IN FABRIC-PAINTING

[76] Inventor: William Perry, P.O. Box 3094, Newport Beach, Calif. 92663

[21] Appl. No.: 487,285

[22] Filed: Mar. 2, 1990

[51] Int. Cl.[5] ..... B44D 3/00

[52] U.S. Cl. ..... 428/81; 156/62; 223/63; 223/71; 428/542.8; 434/84

[58] Field of Search ..... 2/243 B; 223/71, 84; 434/84, 85, 87, 88, 95; 428/12, 81, 542.8; 156/62; 38/102.91

[56] References Cited

U.S. PATENT DOCUMENTS

| | | | |
|---|---|---|---|
| 2,833,074 | 5/1958 | Jannes | 428/12 |
| 3,063,162 | 11/1962 | Quinn | 428/542.6 X |
| 4,295,187 | 10/1981 | Shemitz | 428/12 X |
| 4,501,438 | 2/1985 | McKee | 428/81 X |
| 4,542,055 | 9/1985 | Fitzsimmons | 428/120 X |
| 4,942,683 | 7/1990 | Lawson | 223/71 X |

FOREIGN PATENT DOCUMENTS

| | | | |
|---|---|---|---|
| 1133068 | 11/1956 | France | 428/14 |
| 943864 | 12/1963 | United Kingdom | 428/81 |

*Primary Examiner*—Henry F. Epstein
*Attorney, Agent, or Firm*—Milton S. Gerstein

[57] ABSTRACT

An improved board-insert used in fabric painting and dyeing, in which the flat board is provided with a series of notches or cutouts about its peripheral edge surface, so that any two, oppositely-disposed notches may be used for holding an enwrapped, large rubber or elastic band, which rubber band may then be used as a straight-line guide or edge surface for aiding the fabric painter or dyer in the development of his or her design during the fabric-dyeing process, so that vertical, horizontal, and diagonal lines may be more perfectly formed during the painting process.

18 Claims, 1 Drawing Sheet

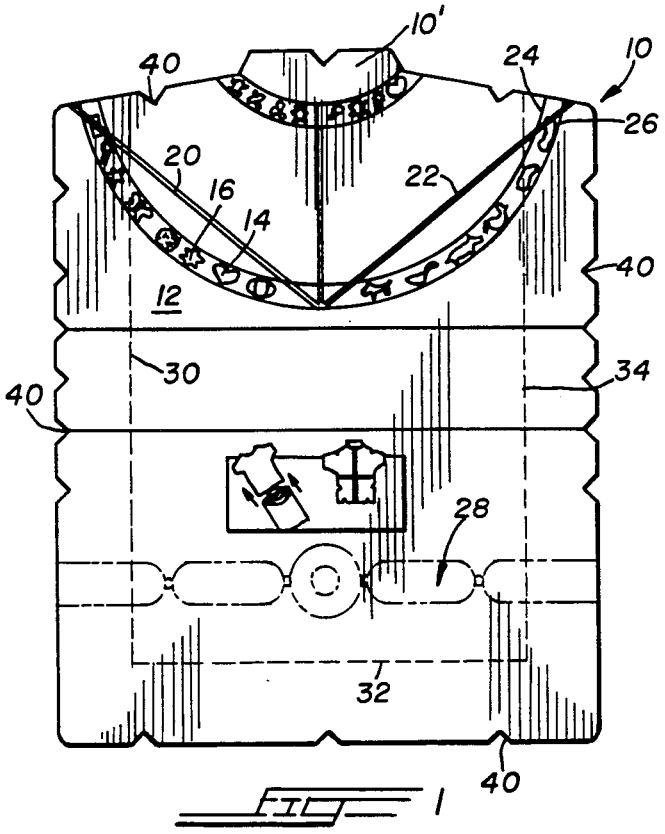
FIG 1
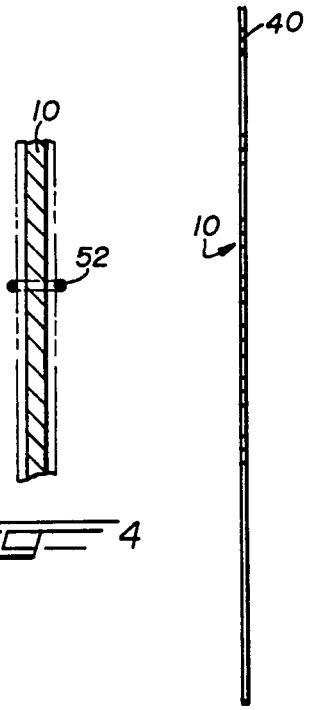
FIG 4
FIG 2
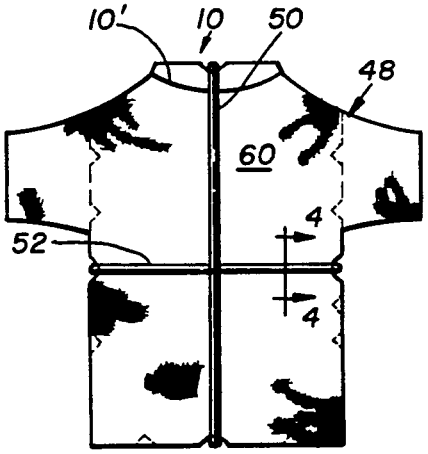
FIG 3
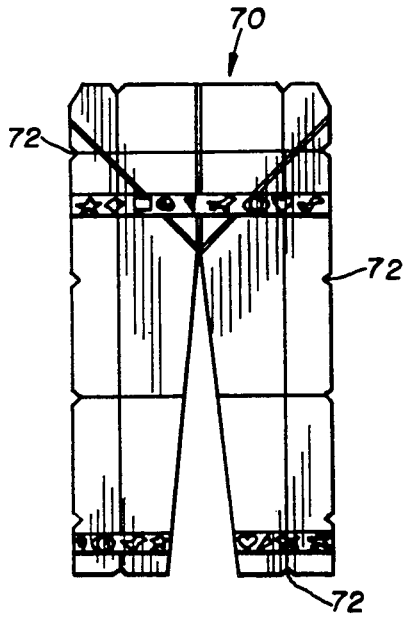
FIG 5

INSERT FOR USE IN FABRIC-PAINTING

BACKGROUND OF THE INVENTION

The present invention is directed to a flat board serving as an insert in a garment by which fabric-painting, fabric-sponging, fabric-splattering, and fabric-dyeing may be performed on the front part or panel of a shirt, sweat shirt, and the like, while preventing the paint or dye from soaking into the rear panel or back portion of the garment. Typically, these flat boards are made of wood composition, plastic, and heavy cardboard, and may contain printed design ideas and printed guide lines to be used by the person doing the painting or decorating of the shirt, fabric, and the like.

SUMMARY OF THE INVENTION

It is the primary objective of the present invention to provide an improved board-insert used in fabric painting and dyeing, in which the flat board is provided with a series of notches or cutouts about its peripheral edge surface, so that any two, oppositely-disposed notches may be used for holding an enwrapped, large rubber or elastic band, which rubber band may then be used as a straight-line guide or edge surface for aiding the fabric painter or dyer in the development of his or her design during the fabric-dyeing process, so that vertical, horizontal, and diagonal lines may be more perfectly formed during the painting process.

BRIEF DESCRIPTION OF THE DRAWING

The invention will be more readily understood with reference to the accompanying drawing, where:

FIG. 1 is a front plan view of the improved flat board for use in fabric painting according to the invention;

FIG. 2 is a side elevational view thereof;

FIG. 3 is a front plan view of the invention shown in use between the front and rear panels of a shirt for fabric-painting;

FIG. 4 is a cross-sectional view taken along line 4—4 of FIG. 3 and

FIG. 5 is a front plan view of a modified flat board of the invention for use in the fabric-painting of pants.

DETAILED DESCRIPTION OF THE INVENTION

Referring now to the drawings in greater detail, the improved flat board for use in fabric-painting, fabric-decorating, and the like, is indicated generally by reference numeral 10. The flat board 10 may be made of wood composition, plastic, or heavy cardboard. The board 10 defines a front planar surface 12 on which are printed various design ideas or suggestions which may be used while performing the fabric-painting. Designs such as a heart 14, star 16, etc. may be included. These printed designs are used when the fabric being dyed or painted is at least partially see-through. Alternatively, these printed designs may be embossed or otherwise have raised surfaces so that when painting opaque fabric, one may "feel" the design during the fabric-painting process. Other such printing aids are: Sloping straight lines 20, 22; curved lines 24, 26; unique designs, such as a belt design 28, etc. Dotted lines 30, 32, and 34 aid the user in cutting the board 10 down to size to fit smaller shirts and other garments.

The above-elements are conventional in presently-used flat boards for fabric-painting, dyeing, and the like. According to the invention, the board 10 is provided with a series of peripheral V-shaped notches or cutouts 40 about its peripheral edge surface, any two opposing ones of which may be used for holding an enwrapped, large rubber or elastic band 50, 52, as shown in FIG. 3., which rubber bands serve as straight edges during the painting process, with each rubber band also serving to hold the shirt or other garment more firmly in place over the board, as shown in FIG. 3. As shown in FIG. 1, there are preferably provided three such notches or cutouts 40 on the top edge surface of the board, and three notches on the bottom edge surface, with the three notches on the upper edge surface being in vertical alignment with the three notches on the bottom edge surface, so that a rubber band may be used to form three differently-located, vertical straight lines or edges. It is noted that the central notch in the upper edge surface is formed in the collar-portion 10', which collar portion is inserted through the neck of a shirt, or the like, when the board 10 is in use. FIG. 3 shows such a vertical straight edge formed by the rubber band 50, which utilizes the central notches on the upper and lower edge surfaces. The side edges of the board are preferably provided with six such notches, with the six on one side edge being in horizontal alignment with the six on the other side edge surface, so that differently positioned, horizontal straight edges may be formed by a rubber band, in the manner shown in FIG. 3. Diagonal straight edges may be formed by using one of the rubber bands 50, 52 and stretching it over and between any two opposing notches, the only requirement being that the two notches be on different edge surfaces. Thus, diagonal lines of various slope may be formed, which serve as straight edges during the fabric-painting process.

In use, a shirt, such as shirt 48 shown in FIG. 3, the front panel or portion 60 of which is to be dyed, painted, or the like, is prepared by inserting the board 10 between the front and rear panels thereof, with the board 10 preventing the paint or dye from soaking into the rear portion of the shirt. The rubber bands 50, 52 are then wrapped about the shirt-board combination at the portions thereof where it is expected that straight edges would be usefully employed, with the rubber bands then inserted into the opposing two notches 40 to be held in place thereby. While only two such rubber bands have been shown, it is clear that any number may be used. Also, the number of notches 40 provided on the peripheral edge surface of the board 10 may also, clearly, vary in number.

It is also within the scope and purview of the invention to provide a board that may be used for the fabric-painting of other garments, such as pants, as shown in FIG. 5. Such a board 70 is pants-shaped, and has a plurality of V-shaped notches 72 provided on its peripheral surface, in the manner above-described.

While a specific embodiment of the invention has been shown and described, it is to be understood that numerous changes and modifications may be made therein without departing from the scope, spirit, and intent of the invention as set forth in the appended claims.

What I claimed is:

1. In a board for use in fabric-painting, fabric-dyeing, fabric-splattering, or fabric-sponging, which board comprises a front surface, a rear surface, and a peripheral edge surface, said board being insertable into a garment between the front and rear portions thereof in order to prevent the paint or dye from soaking into a portion of the garment, the improvement comprising:

said peripheral edge surface comprising a series of spaced-apart notches formed therein; and at least one stretchable rubber band for insertion into two of said notches, whereby said at least one rubber band may be used as a straight edge during the fabric-painting.

2. The improvement according to claim 1, wherein said peripheral edge surface comprises a top edge surface, a bottom edge surface, a first side edge surface, and a second side edge surface, each of said edge surfaces having at least one said notch formed therein.

3. The improvement according to claim 2, wherein each said notch is substantially V-shaped.

4. The improvement according to claim 1, wherein each said notch is V-shaped.

5. The improvement according to claim 1, in combination with a garment, said garment having a front section and a rear section, said board being inserted in said garment between said front section and said rear section, so that when one of said front and rear section is fabric-painted, the other said section is protected by said board.

6. The improvement according to claim 5, wherein said at least one rubber band is enwrapped about said garment, said rubber band having a first loop-end received in one said notch, and a second loop-end received in another said notch.

7. The improvement according to claim 6, wherein said peripheral edge surface comprises a top edge surface, a bottom edge surface, a first side edge surface, and a second side edge surface, each of said edge surfaces having at least one said notch formed therein; said first loop-end being received in a said notch on a respective said surface different from the respective said surface in which is received said second loop-end.

8. The improvemenmt according to claim 7, comprising a plurality of stretchable bands, each said band being received in a different pair of notches, each said pair of notches having a first notch on one of the said peripheral edge surfaces, and a second notch on another of said peripheral edge surfaces, whereby vertical, horizontal, and diagonal straight edge surfaces may be formed.

9. The improvement according to claim 8, wherein said garment is a shirt.

10. The improvement according to claim 8, wherein said garment is pants, said board having a pants-shape.

11. The improvement according to claim 7, wherein the notches formed in said top edge surface and said bottom surface are in vertical alignment, so that a stretchable band between any two opposing notches will provide a vertical edge surface; the notches in said first and second side edge surfaces being in horizontal alignment, so that a stretchable band between two opposing notches will provide a horizontal edge surface.

12. The improvement according to claim 11, wherein each of said top and bottom edge surfaces, and each of side edge surfaces comprises at least three said notches formed therein.

13. A board for use in fabric-painting, fabric-dyeing, fabric-splattering, or fabric-sponging, comprising:

a front surface, a rear surface, and a peripheral edge surface, said board being insertable into a garment between the front and rear portions thereof in order to prevent the paint or dye from soaking into a portion of the garment;

said peripheral edge surface comprising a series of spaced-apart notches formed therein; and at least one stretchable band for insertion into two of said notches, said band being a rubber band and whereby said at least one rubber band may be used as a straight edge during the fabric-painting.

14. The board according to claim 13, wherein the notches formed in said top edge surface and said bottom surface are in vertical alignment, so that a stretchable band between any two opposing notches will provide a vertical edge surface; the notches in said said first and second side edge surfaces being in horizontal alignment so that a stretchable band between two opposing notches will provide a horizontal edge surface.

15. The improvement according to claim 14, in combination with a garment, said garment having a front section and a rear section, said board being inserted in said garment between said front section and said rear section, so that when one of said front and rear section is fabric-painted, the other said section is protected by said board; said at least one rubber band being enwrapped about said garment, said rubber band having a first loop-end received in one said notch of one said edge surface, and a second loop-end received in another said notch of another said edge surface.

16. A method of using a board for use in fabric-painting, fabric-dyeing, fabric-splattering, or fabric-sponging, which board comprises a front surface, a rear surface, and a peripheral edge surface, said peripheral edge surface comprising a series of spaced-apart notches formed therein, said method comprising:

(a) inserting the board into a garment in order to separate a front portion of the garment from a rear portion of the garment;

(b) enwrapping at least one stretchable rubber band about the garment at a location desired;

(c) inserting the ends of the at least one rubber band into opposing notches for securely holding the stetchable band in place as well as the garment on the board;

(d) fabric-painting the desired portion of the garment and utilizing the at least one one stretchable band as a straight-edge surface while doing so.

17. The method according to claim 16, wherein the notches formed in said top edge surface and said bottom surface are in vertical alignment, so that a stretchable band between any two opposing notches will provide a vertical edge surface; the notches in said said first and second side edge surfaces being in horizontal alignment so that a stretchable band between two opposing notches will provide a horizontal edge surface, said step (c) comprising forming at least one of a vertical straight edge, horizontal straight edge, and a diagonal straight-edge.

18. The method according to claim 17, wherein said step (c) comprises enwrapping a plurality of stretchable bands and forming at least one horizontal straight-edge, at least one vertical straight-edge, and at least one diagonal straight-edge.

* * * * *